US010496001B2

(12) United States Patent
Kuramoto

(10) Patent No.: US 10,496,001 B2
(45) Date of Patent: Dec. 3, 2019

(54) TRANSFER DEVICE AND IMAGE FORMING APPARATUS

(71) Applicant: FUJI XEROX CO., LTD., Tokyo (JP)

(72) Inventor: Kazuki Kuramoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/790,067

(22) Filed: Oct. 23, 2017

(65) Prior Publication Data

US 2018/0284636 A1 Oct. 4, 2018

(30) Foreign Application Priority Data

Mar. 29, 2017 (JP) ..... 2017-065173

(51) Int. Cl.

| | |
|---|---|
| ***G03G 15/02*** | (2006.01) |
| ***G03G 15/01*** | (2006.01) |
| ***G03G 15/16*** | (2006.01) |
| ***G03G 15/00*** | (2006.01) |

(52) U.S. Cl.

CPC ..... *G03G 15/0266* (2013.01); *G03G 15/0189* (2013.01); *G03G 15/1675* (2013.01); *G03G 15/0131* (2013.01); *G03G 15/553* (2013.01); *G03G 15/556* (2013.01); *G03G 15/6591* (2013.01)

(58) Field of Classification Search

CPC ..... G03G 15/0266; G03G 15/0131; G03G 15/0189

See application file for complete search history.

(56) References Cited

U.S. PATENT DOCUMENTS

| | | | | |
|---|---|---|---|---|
| 2011/0222128 | A1* | 9/2011 | Wada | G03G 15/0131 358/3.27 |
| 2014/0133874 | A1* | 5/2014 | Morizaki | G03G 15/80 399/37 |
| 2014/0147145 | A1* | 5/2014 | Yoshioka | G03G 15/1675 399/66 |
| 2016/0077456 | A1* | 3/2016 | Kojima | G03G 15/0266 399/50 |

FOREIGN PATENT DOCUMENTS

| | | |
|---|---|---|
| JP | 2013-117673 | 6/2013 |
| JP | 2013-125263 | 6/2013 |
| JP | 2014-059461 | 4/2014 |

* cited by examiner

*Primary Examiner* — Ryan D Walsh
(74) *Attorney, Agent, or Firm* — JCIPRNET

(57) ABSTRACT

A transfer device includes a transfer member that transfers a visible image on an image bearing member onto a medium. When an image forming rate is low, a total amount of transfer current to be supplied to a transfer region where the image bearing member and the transfer member face each other is increased, as compared with when the image forming rate is high.

10 Claims, 4 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2017-065173 filed Mar. 29, 2017.

BACKGROUND

Technical Field

The present invention relates to transfer devices and image forming apparatuses.

SUMMARY

According to an aspect of the invention, there is provided a transfer device including a transfer member that transfers a visible image on an image bearing member onto a medium. When an image forming rate is low, a total amount of transfer current to be supplied to a transfer region where the image bearing member and the transfer member face each other is increased, as compared with when the image forming rate is high.

BRIEF DESCRIPTION OF THE DRAWINGS

An exemplary embodiment of the present invention will be described in detail based on the following figures, wherein.

DETAILED DESCRIPTION

Figure 1:
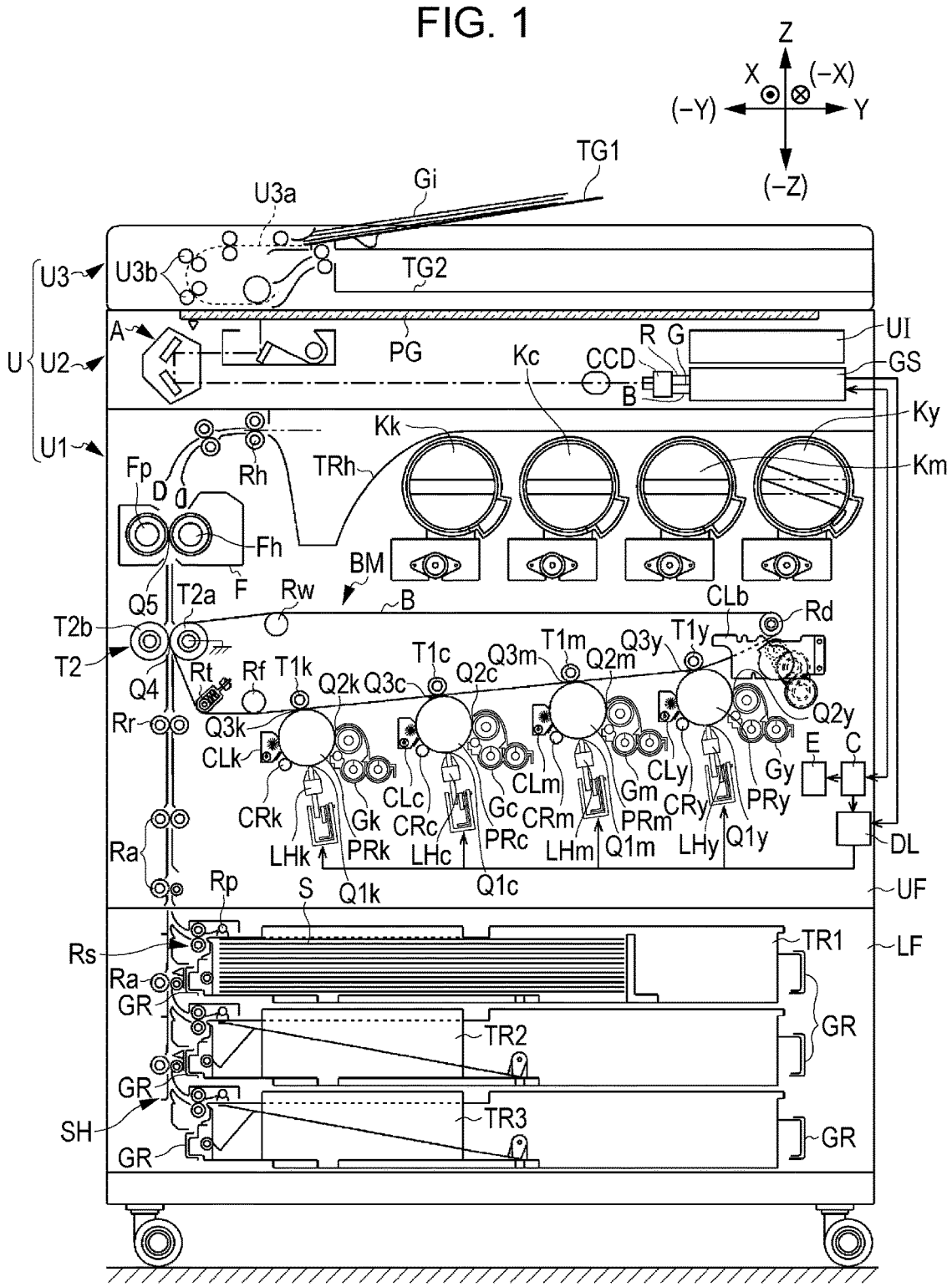
FIG. 1 illustrates an image forming apparatus according to a first exemplary embodiment.

Although a specific exemplary embodiment of the present invention will be described below with reference to the drawings, the present invention is not to be limited to the following exemplary embodiment.

In order to provide an easier understanding of the following description, the front-rear direction will be defined as "X-axis direction" in the drawings, the left-right direction will be defined as "Y-axis direction", and the up-down direction will be defined as "Z-axis direction". Moreover, the directions or the sides indicated by arrows X, -X, Y, -Y, Z, and -Z are defined as forward, rearward, rightward, leftward, upward, and downward directions, respectively, or as front, rear, right, left, upper, and lower sides, respectively.

Furthermore, in each of the drawings, a circle with a dot in the center indicates an arrow extending from the far side toward the near side of the plane of the drawing, and a circle with an "x" therein indicates an arrow extending from the near side toward the far side of the plane of the drawing.

In the drawings used for explaining the following description, components other than those for providing an easier understanding of the description are omitted where appropriate.

First Exemplary Embodiment

FIG. 1 illustrates an image forming apparatus according to a first exemplary embodiment.

Figure 2:
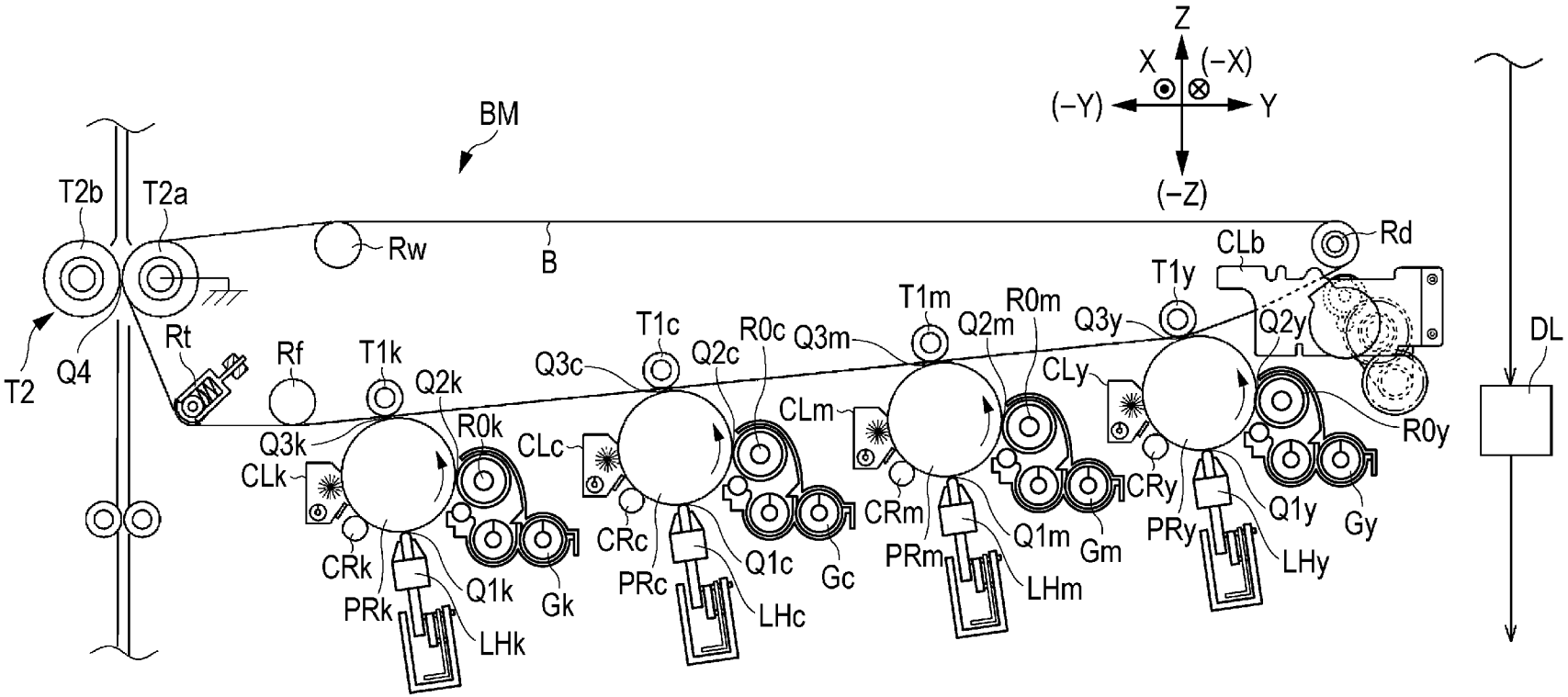
FIG. 2 illustrates a relevant part of the image forming apparatus according to the first exemplary embodiment.

FIG. 2 illustrates a relevant part of the image forming apparatus according to the first exemplary embodiment.

In FIG. 1, a copier U as an example of the image forming apparatus according to the first exemplary embodiment of the present invention is an example of an apparatus body and has a printer unit U1 as an example of an image recording device. A scanner unit U2 as an example of a reader as well as an example of an image reading device is supported at the upper portion of the printer unit U1. An auto feeder U3 as an example of a document transport device is supported at the upper portion of the scanner unit U2. The scanner unit U2 according to the first exemplary embodiment supports a user interface U1 as an example of an input unit. An operator may input information to the user interface U1 so as to operate the copier U.

A document tray TG1 as an example of a medium container is disposed at the upper portion of the auto feeder U3. The document tray TG1 is capable of accommodating a stack of multiple documents Gi to be copied. A document output tray TG2 as an example of a document output unit is provided below the document tray TG1. Document transport rollers U3*b* are arranged along a document transport path U3*a* between the document tray TG1 and the document output tray TG2.

Platen glass PG as an example of a transparent document table is disposed at the upper surface of the scanner unit U2. In the scanner unit U2 according to the first exemplary embodiment, a reading optical system A is disposed below the platen glass PG. The reading optical system A according to the first exemplary embodiment is supported in a movable manner in the left-right direction along the lower surface of the platen glass PG. Normally, the reading optical system A is in a stopped state at an initial position shown in FIG. 1.

An imaging element CCD as an example of an imaging member is disposed to the right of the reading optical system A. The imaging element CCD is electrically connected to an image processor GS.

The image processor GS is electrically connected to a write circuit DL of the printer unit U1. The write circuit DL is electrically connected to light-emitting-diode (LED) heads LHy, LHm, LHc, and LHk as an example of latent-image forming devices.

Photoconductor drums PRy, PRm, PRc, and PRk as an example of image bearing members are respectively disposed above the LED heads LHy to LHk.

Charging rollers CRy, CRm, CRc, and CRk as an example of charging units are respectively disposed facing the photoconductor drums PRy to PRk. The charging rollers CRy to CRk receive charge voltage from a power supply circuit E. The charging rollers CRy, CRm, CRc, and CRk in the first exemplary embodiment are supplied with electric power by using a direct-current power source. Specifically, although the charge voltage in the first exemplary embodiment is a direct-current voltage alone and does not have an alternating-current voltage superposed thereon, an alternating current may be superposed on a direct current.

The power supply circuit E is controlled by a controller C. The controller C performs various kinds of control by exchanging signals with, for example, the image processor GS and the write circuit DL.

In write regions Q1*y*, Q1*m*, Q1*c*, and Q1*k* set downstream of the charging rollers CRy to CRk in the rotational direction of the photoconductor drums PRy to PRk, the LED heads LHy to LHk radiate write light onto the surfaces of the photoconductor drums PRy to PRk.

In developing regions Q2*y*, Q2*m*, Q2*c*, and Q2*y* set downstream of the write regions Q1*y* to Q1*k* in the rotational direction of the photoconductor drums PRy to PRk, developing devices Gy, Gm, Gc, and Gk are disposed facing the surfaces of the respective photoconductor drums PRy to PRk.

First-transfer regions Q3*y*, Q3*m*, Q3*c*, and Q3*k* are set downstream of the developing regions Q2*y* to Q2*y* in the rotational direction of the photoconductor drums PRy to PRk. In the first-transfer regions Q3*y* to Q3*k*, the photoconductor drums PRy to PRk are in contact with an intermediate transfer belt B as an example of an intermediate transfer member as well as an example of a medium. Furthermore, in the first-transfer regions Q3*y*, Q3*m*, Q3*c*, and Q3*k*, first-transfer rollers T1*y*, T1*m*, T1*c*, and T1*k* as an example of first-transfer units as well as an example of transfer members are disposed opposite the photoconductor drums PRy to PRk with the intermediate transfer belt B interposed therebetween. In the first exemplary embodiment, first-transfer voltage to be applied to the first-transfer rollers T1*y* to T1*k* undergoes so-called constant current control such that an electric current value to be supplied becomes a preset value.

Drum cleaners CLy, CLm, CLc, and CLk as an example of image-bearing-member cleaning units are disposed downstream of the first-transfer regions Q3*y* to Q3*k* in the rotational direction of the photoconductor drums PRy to PRk. The copier U according to the first exemplary embodiment is not provided with a charge remover that removes electric charge from the surfaces of the photoconductor drums PRy to PRk after passing through the first-transfer regions Q3*y* to Q3*k*.

A belt module BM as an example of an intermediate transfer device is disposed above the photoconductor drums PRy to PRk. The belt module BM has the aforementioned intermediate transfer belt B. The intermediate transfer belt B is supported in a rotatable manner by a driving roller Rd as an example of a driving member, a tension roller Rt as an example of a tension member, a working roller Rw as an example of a meander correction member, an idler roller Rf as an example of a driven member, a backup roller T2*a* as an example of a second-transfer-region opposing member, and the first-transfer rollers T1*y*, T1*m*, T1*c*, and T1*k*.

A second-transfer roller T2*b* as an example of a second-transfer member is disposed opposite the backup roller T2*a* with the intermediate transfer belt B interposed therebetween. The backup roller T2*a* and the second-transfer roller T2*b* constitute a second-transfer unit T2. A second-transfer region Q4 is formed by a region where the second-transfer roller T2*b* and the intermediate transfer belt B face each other.

For example, the first-transfer rollers T1*y* to T1*k*, the intermediate transfer belt B, and the second-transfer unit T2 constitute a transfer device T1+T2+B according to the first exemplary embodiment that transfers images formed on the photoconductor drums PRy to PRk onto a medium.

A belt cleaner CLb as an example of an intermediate-transfer-member cleaning unit is disposed downstream of the second-transfer region Q4 in the rotational direction of the intermediate transfer belt B.

Cartridges Ky, Km, Kc, and Kk as an example of developer containers are disposed above the belt module BM. The cartridges Ky to Kk accommodate developers to be supplied to the developing devices Gy to Gk. The cartridges Ky to Kk and the developing devices Gy to Gk are respectively connected by developer supplying devices (not shown).

Feed trays TR1 to TR3 as an example of medium containers are disposed at the lower portion of the printer unit U1. The feed trays TR1 to TR3 are supported in a detachable manner in the front-rear direction by guide rails GR as an example of guide members. The feed trays TR1 to TR3 accommodate sheets S therein as an example of media.

A pickup roller Rp as an example of a medium pickup member is disposed at the upper left side of each of the feed trays TR1 to TR3. A separation roller Rs as an example of a separation member is disposed to the left of the pickup roller Rp.

A medium transport path SH extending upward is provided to the left of the feed trays TR1 to TR3. The transport path SH has multiple transport rollers Ra arranged therein as an example of medium transport members. In a downstream area of the transport path SH in the transport direction of the sheet S, a registration roller Rr as an example of a delivery member is disposed upstream of the second-transfer region Q4.

A fixing device F is disposed above the second-transfer region Q4. The fixing device F has a heating roller Fh as an example of a heating member, and also has a pressure roller Fp as an example of a pressure member. A contact region between the heating roller Fh and the pressure roller Fp constitutes a fixing region Q5.

An output roller Rh as an example of a medium transport member is disposed obliquely above the fixing device F. An output tray TRh as an example of a medium output unit is provided to the right of the output roller Rh.

Image Forming Operation

The multiple documents Gi accommodated in the document tray TG1 sequentially pass over a document read position on the platen glass PG and are output onto the document output tray TG2.

In a case where copying is to be performed by transporting the documents Gi automatically by using the auto feeder U3, the documents Gi sequentially passing over the read position on the platen glass PG are exposed to light with the reading optical system A maintained in the stopped state at the initial position.

In a case where copying is to be performed by allowing the operator to manually place a document Gi on the platen glass PG, the reading optical system A moves in the left-right direction so that the document Gi on the platen glass PG is scanned while being exposed to light.

Reflected light from the document Gi travels through the reading optical system A and is focused on the imaging element CCD. The imaging element CCD converts the reflected light from the document Gi focused on an imaging surface thereof into red (R), green (G), and blue (B) electric signals.

The image processor GS converts the RGB electric signals input from the imaging element CCD into black (K), yellow (Y), magenta (M), and cyan (C) image information and temporarily stores the image information. The image processor GS outputs the temporarily-stored image information as image information for latent-image formation to the write circuit DL at a preset timing.

If the document image is a monochromatic image, only the black (K) image information is input to the write circuit DL.

The write circuit DL has Y, M, C, and K drive circuits (not shown). The write circuit DL outputs signals according to the input image information at a preset timing to the LED heads LHy to LHk arranged for the respective colors.

The surfaces of the photoconductor drums PRy to PRk are electrostatically charged by the charging rollers CRy to CRk. In the write regions Q1*y* to Q1*k*, the LED heads LHy to LHk form electrostatic latent images on the surfaces of the photoconductor drums PRy to PRk. In the developing regions Q2*y* to Q2*y*, the developing devices Gy to Gk develop the electrostatic latent images on the surfaces of the photoconductor drums PRy to PRk into toner images as an example of visible images. When the developers are consumed in the developing devices Gy to Gk, the developing devices Gy to Gk are supplied with new developers from the respective cartridges Ky to Kk in accordance with the consumed amounts.

The toner images on the surfaces of the photoconductor drums PRy to PRk are transported to the first-transfer regions Q3*y*, Q3*m*, Q3*c*, and Q3*k*. The first-transfer rollers T1*y* to T1*k* receive first-transfer voltage with a polarity opposite from the charge polarity of the toners from the power supply circuit E at a preset timing. Therefore, in the first-transfer regions Q3*y* to Q3*k*, the toner images on the photoconductor drums PRy to PRk are sequentially superposed and transferred onto the intermediate transfer belt B in accordance with the first-transfer voltage. In the case of a K monochromatic image, the K toner image alone is transferred onto the intermediate transfer belt B from the K photoconductor drum PRk.

The toner images on the photoconductor drums PRy to PRk are first-transferred onto the intermediate transfer belt B as an example of an intermediate transfer member by the first-transfer rollers T1*y*, T1*m*, T1*c*, and T1*k*. Residues and extraneous matter on the surfaces of the photoconductor drums PRy to PRk after the first-transfer process are cleaned off by the drum cleaners CLy to CLk. The cleaned surfaces of the photoconductor drums PRy to PRk are electrostatically charged again by the charging rollers CRy to CRk.

A sheet S from one of the feed trays TR1 to TR3 is picked up by the corresponding pickup roller Rp at a preset feed timing. If multiple sheets S in a stacked state are picked up by the pickup roller Rp, the separation roller Rs separates the sheets S in a one-by-one fashion. The sheet S that has passed the separation roller Rs is transported to the registration roller Rr by the multiple transport rollers Ra.

The registration roller Rr delivers the sheet S in accordance with the timing at which the toner images on the surface of the intermediate transfer belt B move to the second-transfer region Q4.

When the sheet S delivered from the registration roller Rr passes through the second-transfer region Q4, the toner images on the surface of the intermediate transfer belt B are transferred onto the sheet S in accordance with second-transfer voltage applied to the second-transfer roller T2*b*.

After the intermediate transfer belt B passes through the second-transfer region Q4, the belt cleaner CLb cleans the surface of the intermediate transfer belt B by removing residual toner therefrom.

The sheet S that has passed through the second-transfer region Q4 subsequently passes through the fixing region Q5 where the toner images are fixed onto the sheet S by being heated and pressed by the fixing device F.

The sheet S having the toner images fixed thereon is output to the output tray TRh by the output roller Rh.

Controller According to First Exemplary Embodiment

Figure 3:
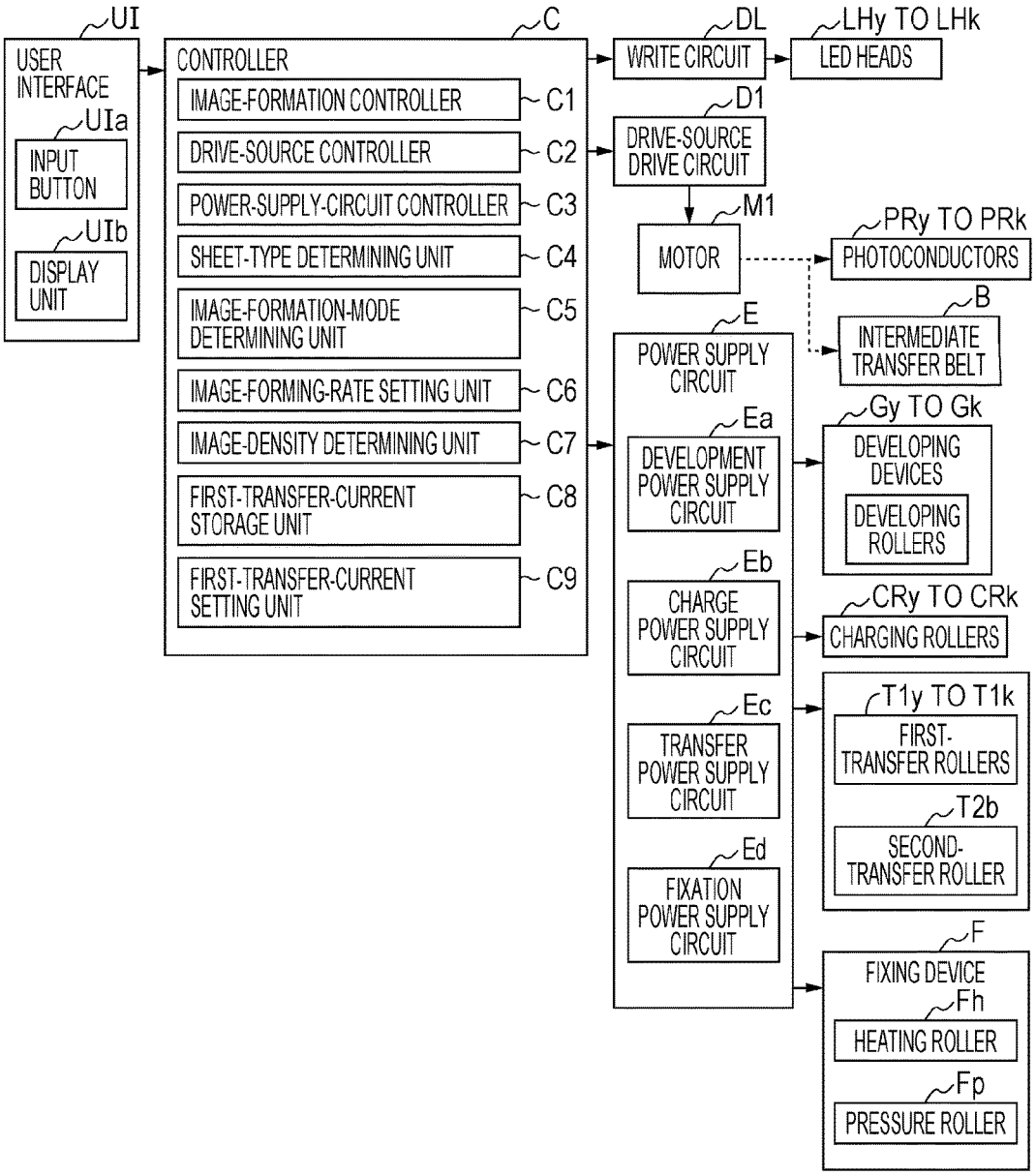
FIG. 3 is a block diagram illustrating functions included in a controller of the image forming apparatus according to the first exemplary embodiment.

FIG. 3 is a block diagram illustrating functions included in the controller of the image forming apparatus according to the first exemplary embodiment.

In FIG. 3, the controller C has an input-output interface I/O used for, for example, receiving and outputting signals from and to the outside. Furthermore, the controller C has a read-only memory (ROM) that stores, for example, programs and information used for performing processes. The controller C also has a random access memory (RAM) for temporarily storing data. Moreover, the controller C has a central processing unit (CPU) that performs a process according to a program stored in, for example, the ROM. Therefore, the controller C according to the first exemplary embodiment is constituted by a small-size information processing device, that is, a so-called microcomputer. Accordingly, the controller C is capable of realizing various functions by executing the programs stored in, for example, the ROM.

Signal Output Components Connected to Controller C

The controller C receives output signals from signal output components, such as the user interface U1 and sensors (not shown).

The user interface U1 includes an input button U1*a* as an example of an input member for inputting, for example, an arrow. The user interface U1 also includes, for example, a display unit U1*b* as an example of a notification member.

Controlled Components Connected to Controller C

The controller C is connected to a drive-source drive circuit D1, the power supply circuit E, and other controlled components (not shown). The controller C outputs control signals to, for example, the circuits D1 and E.

The drive-source drive circuit D1 rotationally drives, for example, the photoconductor drums PRy to PRk and the intermediate transfer belt B via a motor M1 as an example of a drive source.

The power supply circuit E includes a development power supply circuit Ea, a charge power supply circuit Eb, a transfer power supply circuit Ec, and a fixation power supply circuit Ed.

The development power supply circuit Ea applies development voltage to developing rollers of the developing devices Gy to Gk.

The charge power supply circuit Eb applies charge voltage to the charging rollers CRy to CRk so as to electrostatically charge the surfaces of the photoconductor drums PRy to PRk.

The transfer power supply circuit Ec applies transfer voltage to the first-transfer rollers T1*y* to T1*k* and the backup roller T2*a*.

The fixation power supply circuit Ed supplies electric power to an induction heater 8 for the heating roller Fh of the fixing device F.

Functions of Controller C

The controller C has a function of executing processes according to input signals from the signal output components and outputting control signals to the controlled components. Specifically, the controller C has the following functions.

An image-formation controller C1 controls, for example, the driving of each component in the copier U and the voltage application timing in accordance with image information read by the scanner unit U2 or image information input from, for example, an external personal computer so as to execute a job, which is an image forming operation.

A drive-source controller C2 controls the driving of the motor M1 via the drive-source drive circuit D1 so as to control the driving of, for example, the photoconductor drums PRy to PRk.

A power-supply-circuit controller C3 controls the power supply circuits Ea to Ed so as to control the voltage to be applied to each component and the electric power to be supplied to each component.

A sheet-type determining unit C4 determines the type of medium to be used for printing. In the first exemplary embodiment, information about the types of sheets accommodated in the feed trays TR1 to TR3 is registered in advance, and the sheet type is determined by acquiring the registered sheet-type information with respect to one of the feed trays TR1 to TR3 from which sheets are to be fed. Examples of the registered sheet types include thin paper, plain paper, thick paper, and overhead projector (OHP) sheets, which are distinguishable from one another.

An image-formation-mode determining unit C5 determines an image print mode in accordance with an input to the user interface U1. Examples of image formation modes to be determined by the image-formation-mode determining unit C5 according to the first exemplary embodiment include a black monochrome print mode, that is, a so-called monochrome mode, and a full-color print mode, that is, a so-called full-color mode.

An image-forming-rate setting unit C6 sets the image forming rate in the copier U. For example, the image-forming-rate setting unit C6 according to the first exemplary embodiment sets the image forming rate to either a first image forming rate PS1 or a second image forming rate PS2 that is higher than the first image forming rate PS1. The image-forming-rate setting unit C6 according to the first exemplary embodiment sets the image forming rate to the first image forming rate PS1, which is the lower rate, if the sheet type is thick paper or an OHP sheet, and sets the image forming rate to the second image forming rate PS2, which is the higher rate, if the sheet type is plain paper or thin paper. Furthermore, the image-forming-rate setting unit C6 according to the first exemplary embodiment sets the image forming rate to the first image forming rate PS1, which is the lower rate, in a case where the image forming operation is in the full-color mode, and sets the image forming rate to the second image forming rate PS2, which is the higher rate, in a case where the image forming operation is in the monochrome mode. Therefore, in the first exemplary embodiment, the image forming rate is set to the second image forming rate PS2 if the sheet type is plain paper or thin paper and the image forming operation is in the monochrome mode. Otherwise, the image forming rate is set to the first image forming rate PS1.

An image-density determining unit C7 determines the density of an image to be printed. The image-density determining unit C7 according to the first exemplary embodiment calculates the density of an image to be written by each of the LED heads LHy to LHk based on the percentage of the number of pixels of the image relative to the total number of pixels. If the calculated density of the image reaches a predetermined threshold value, the image-density determining unit C7 determines that the image is a high-density image. The threshold value may be set to, for example, 10%. Of the Y, M, C, and K images, the image-density determining unit C7 according to the first exemplary embodiment determines the image densities of the Y and M images disposed at the upstream side in the rotational direction of the intermediate transfer belt B.

Figure 4:
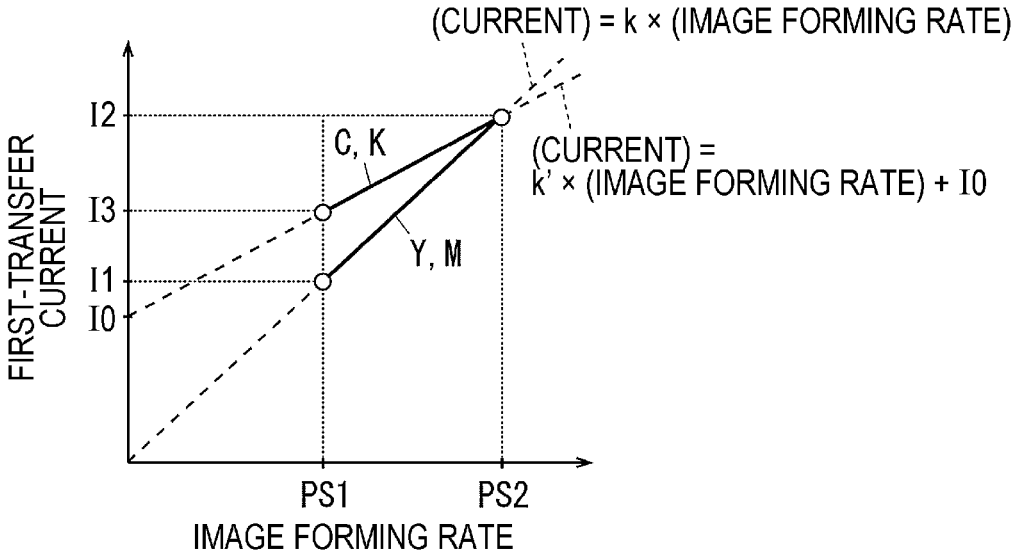
FIG. 4 is a graph illustrating the settings of first-transfer currents in the first exemplary embodiment, in which the abscissa axis denotes an image forming rate and the ordinate axis denotes a first-transfer current.

FIG. 4 is a graph illustrating the settings of first-transfer currents in the first exemplary embodiment, in which the abscissa axis denotes an image forming rate and the ordinate axis denotes a first-transfer current.

A first-transfer-current storage unit C8 stores first-transfer currents I1 to I3 to be supplied to the first-transfer rollers T1*y* to T1*k* during an image forming operation. In FIG. 4, the first-transfer-current storage unit C8 according to the first exemplary embodiment stores information indicating that a first first-transfer current I1 is to be supplied to the first-transfer rollers T1*y* and T1*m* for the Y and M colors in the case of the first image forming rate PS1 and that a second first-transfer current 12 is to be supplied in the case of the second image forming rate PS2. The first-transfer currents I1 and I2 are set to values that satisfy the relationship I1:I2=PS1:PS2 such that the total amount of current is maintained. Specifically, for the Y and M colors, the transfer currents I1 and I2 are controlled so as to be proportional to the image forming rate. Thus, the total amounts of current I1/PS1 and I2/PS2 indicating the products of the first-transfer current values I1 and I2, which indicate the amounts of charge supplied per unit time, and the passing timings $PS1^{-1}$ and $PS1^{-2}$ of the intermediate transfer belt B as an example of a medium are set so as to match.

The first-transfer-current storage unit C8 according to the first exemplary embodiment stores information indicating that a third first-transfer current I3 or the first first-transfer current I1 is to be supplied to the first-transfer rollers T1*c* and T1*k* for the C and K colors in the case of the first image forming rate PS1, and that the second first-transfer current I2 is to be supplied in the case of the second image forming rate PS2. The third first-transfer current I3 is set to a value larger than the first first-transfer current I1. For example, in the first exemplary embodiment, the third first-transfer current I3 is set to a value that is 20% larger than the first first-transfer current I1, that is, I3=1.2×I1.

Therefore, in the case where the third first-transfer current I3 is to be supplied for the C and K colors, the total amount of current to be supplied to the first-transfer regions Q3*y* to Q3*k* is set to be larger than in the case of the first first-transfer current Ii or the second first-transfer current I2. Therefore, I3/PS1>I1/PS1=I2/PS2. Thus, a difference (I2−I3) between the second first-transfer current I2 and the third first-transfer current I3 is smaller than a difference (I2−I1) between the second first-transfer current I2 and the first first-transfer current I1. Specifically, I2−I3<I2−I1. Accordingly, a decrease in first-transfer current when the image forming rate decreases is smaller in the case where the third first-transfer current I3 is supplied. In other words, for the Y and M colors, a current value is set in accordance with a straight line in which (current value)=k×(image forming rate) when k is a proportionality coefficient, whereas for the C and K colors, a current value is set in accordance with a straight line in which (current value)=k'×(image forming rate)+I0 when the proportionality coefficient k' is smaller than the proportionality coefficient k.

A first-transfer-current setting unit C9 sets the first-transfer currents I1 to I3. The first-transfer-current setting unit C9 according to the first exemplary embodiment sets the first-transfer currents I1 to I3 in accordance with the image forming rate PS1 or PS2 and the image density during the image forming operation. In the first exemplary embodiment, the first-transfer-current setting unit C9 sets the first-transfer current to one of the first-transfer currents I1 to I3 stored in the first-transfer-current storage unit C8 in accordance with the image forming rate PS1 or PS2. Furthermore, if the image density of the Y or M image at the upstream side reaches the threshold value when the image forming rate is set to the low rate, the first-transfer-current setting unit C9 according to the first exemplary embodiment sets the first-transfer current for the C and K colors at the downstream side to the third first-transfer current I3. On the other hand, if the image density of the Y or M image at the upstream side does not reach the threshold value even when the image forming rate is set to the low rate, the first-transfer-current setting unit C9 according to the first exemplary embodiment sets the first-transfer current for the C and K colors at the downstream side to the first first-transfer current I1. The controller C according to the first exemplary embodiment performs control so as to cause the power-supply-circuit controller C3 to supply the first-transfer currents I1 to 13 set in the first-transfer-current setting unit C9 to the first-transfer rollers T1*y* to T1*k*.

Operation of First Exemplary Embodiment

In the copier U according to the first exemplary embodiment having the above-described configuration, the image forming rate PS1 or PS2 is set in accordance with the sheet type and the image formation mode. Moreover, the first-transfer currents I1 to I3 are set in accordance with the image forming rate PS1 or PS2.

In the configuration of the related art, such as Japanese Unexamined Patent Application Publication Nos. 2013-117673, 2013-125263, and 2014-059461, the first-transfer current is normally controlled such that the total charge amount is kept fixed even if the image forming rate changes. Specifically, when the image forming rate decreases, the rate at which an image passes through a first-transfer region also decreases. This corresponds to a decrease in the amount of developer per unit time, and the first-transfer current value is normally reduced accordingly so as to maintain the charging ability.

In the first-transfer regions Q3*y* to Q3*k*, images are transferred onto the intermediate transfer belt B by using the first-transfer voltage applied to the first-transfer rollers T1*y* to T1*k*. With regard to the first-transfer voltage, voltage with a polarity opposite from that of the charge voltage of the photoconductor drums PRy to PRk is applied. Therefore, when the photoconductor drums PRy to PRk pass through the first-transfer regions Q3*y* to Q3*k*, electric charge is removed from the surfaces of the photoconductor drums PRy to PRk by using the first-transfer voltage. When the image forming rate is the low rate, if the first-transfer current decreases in proportion thereto as in the related art, the charging ability is maintained, but the charge removing ability deteriorates. Thus, if electric charge is not sufficiently removed from the surfaces of the photoconductor drums PRy to PRk, the electric charge according to the previously-formed images remains on the surfaces of the photoconductor drums PRy to PRk. Such residual electric charge may possibly lead to an image defect, such as a so-called ghost phenomenon in which the images slightly appear in subsequently-formed images.

In particular, in a configuration not having a charge remover, the removal of residual electric charge is dependent on self-discharge, and the effect of residual electric charge tends to occur readily. In a configuration that performs charging by using a direct-current power source alone for the charging rollers CRy to CRk, the charging ability is lower than in the case where alternating-current voltage is superposed on direct-current voltage, thus causing the effect of the residual electric charge to remain in the charging process.

In contrast, in the first exemplary embodiment, when the image forming rate is the low rate PS1, the first-transfer current is set to the third first-transfer current I3 so that the total amount of current is larger than in the case where the image forming rate is the high rate PS2. Therefore, the charge removing abilities in the first-transfer rollers T1*c* and T1*k* are higher than in the control in the related art. Accordingly, defective charge removal from the photoconductor drums PRc and PRk is reduced, thereby suppressing the occurrence of image defects, such as a ghost phenomenon.

In particular, in the first-transfer region Q3*y* for the Y color among the first-transfer regions Q3*y* to Q3*k* for the four colors, the Y-color image alone is nipped between the photoconductor drum PRy and the first-transfer roller T1*y*, whereas in the first-transfer region Q3*k* for the K color, the images of the four colors, that is, the Y, M, C, and K colors, are nipped between the photoconductor drum PRk and the first-transfer roller T1*k*. The toners constituting the respective images are electrostatically charged, so that the amount of electric charge entering the first-transfer regions Q3*y* to Q3*k* increases as the number of superposed images increases. Therefore, the removal of electric charge from the photoconductor drums PRy to PRk by the first-transfer rollers T1*y* to T1*k* becomes more difficult toward the downstream side. If the first-transfer current is increased more than necessary, the effects of the resistance values of the components PRy, PRk, B, and T1*y* to T1*k* increase, possibly resulting in the occurrence of defective transfer.

In contrast, in the first exemplary embodiment, control is performed such that the third first-transfer current I3 is set for the C and K colors at the downstream side where the removal of electric charge is more difficult, and control similar to that in the related art is performed for the Y and M colors at the upstream side where defective transfer may possibly occur. Consequently, an increase in the occurrence of defective transfer may be suppressed while the occurrence of defective charge removal may be reduced, as compared with the related art.

As described above, defective charge removal tends to occur as the amount of toner entering the first-transfer regions Q3*y* to Q3*k* increases. Therefore, defective charge removal is more likely to occur with respect to images with high image density, whereas defective charge removal is less likely to occur with respect to images with low image density. In particular, in the case of an image forming apparatus that uses four colors, that is, Y, M, C, and K colors, for example, if a large number of flyers with many red-color images for attracting attention are to be printed and output, the red color is output by increasing the concentration of the Y-color and M-color developers, causing the densities of the Y color and the M color at the upstream side to increase. In this case, defective charge removal may possibly occur at the downstream side where the Y-color and M-color high-density images are superposed.

Accordingly, in the first exemplary embodiment, if the Y-color or M-color image at the upstream side has a density higher than a threshold value, control is performed on the first-transfer rollers T1*c* and T1*k* for the C and K colors such that the third first-transfer current I3 is supplied when the image forming rate is the low rate. On the other hand, if the Y-color or M-color image at the upstream side has a low density, control is performed on the first-transfer rollers T1*c* and T1*k* for the C and K colors such that the first first-transfer current I1 is supplied even when the image forming rate is the low rate. Specifically, control similar to that in the related art is performed without performing the control for supplying the third first-transfer current I3. Therefore, in the first exemplary embodiment, in a condition where defective charge removal tends to occur, the third first-transfer current I3 is supplied so that defective charge removal may be suppressed. In a condition where defective charge removal is less likely to occur, the first first-transfer current I1 is supplied so that the occurrence of defective transfer may be suppressed.

Furthermore, in the case of the monochrome mode and the full-color mode, the amount of toner entering the first-transfer regions Q3*y* to Q3*k* decreases. In the first exemplary embodiment, the image forming rate is set to the low rate in the case of the full-color mode so that the total amount of current is set to be larger than in the case of the monochrome mode. Therefore, in the full-color mode, the total amount of current increases, so that the occurrence of defective charge removal may be suppressed. On the other hand, in the monochrome mode, the control for increasing the total amount of current is not performed, so that the occurrence of defective transfer may be suppressed.

In the first exemplary embodiment, a charge remover is not provided, and defective charge removal is dealt with by controlling the total amount of current. Therefore, the number of components and the manufacturing costs may be reduced while defective charge removal may be suppressed, as compared with a configuration provided with a charge remover.

Furthermore, in the first exemplary embodiment, the charging rollers CRy to CRk are supplied with electric power from a direct-current power source. Therefore, in the first exemplary embodiment, a low-cost configuration with a low charging ability may be employed while the occurrence of defective charge removal may be suppressed, as compared with a case where alternating-current voltage is superposed on direct-current voltage.

Modifications

Although the exemplary embodiment of the present invention has been described in detail above, the present invention is not to be limited to the above exemplary embodiment and permits various modifications within the technical scope of the invention defined in the claims. Modifications H01 to H010 will be described below.

In a first modification H01, the image forming apparatus according to the above exemplary embodiment is not limited to the copier U, and may be, for example, a printer, a facsimile apparatus or a multifunction apparatus having multiple functions or all functions of such apparatuses.

In the copier U according to the above exemplary embodiment, developers for four colors are used. Alternatively, for example, in a second modification H02, the exemplary embodiment may also be applied to a monochrome image forming apparatus or a multicolor image forming apparatus that uses five or more colors or three or fewer colors. Furthermore, although images are transferred from the photoconductor drums PRy to PRk as an example of image bearing members onto the intermediate transfer belt B as an example of a medium in the first exemplary embodiment, the exemplary embodiment is not limited to the configuration having the intermediate transfer belt B. For example, the exemplary embodiment is also applicable to a configuration that directly transfers an image from a photoconductor onto paper or an OHP sheet as an example of a medium.

In the above exemplary embodiment, the numerical values and materials are not limited to those exemplified. In a third modification H03, the numerical values and materials may be changed, where appropriate, in accordance with the design and specifications.

The configuration in the above exemplary embodiment performs control for increasing the total amount of current for the C and K colors of the four colors. Alternatively, for example, in a fourth modification H04, control for increasing the total amount of current for all of the colors may be performed. As another alternative, control for increasing the total amount of current for the M, C, and K colors may be performed, or control for increasing the total amount of current for the K color alone may be performed. Specifically, the total amount of current may be set to have the relationship K>C≥M≥Y, K≥C>M≥Y, or K≥C≥M>Y. In particular, if a black-color image is to be formed by superposing Y, M, and C high-density images one on top of another, the charge removing ability becomes difficult for the K color. In order to cope with such a case, the total amount of current may be increased for the K color alone (i.e., the total amount of current may be set to have the relationship K>C=M=Y).

Although it is desirable to perform control for increasing the total amount of current when the image density is high and to not perform the control for increasing the total amount of current when the image density is low in the above exemplary embodiment, the exemplary embodiment is not limited to this configuration. In a fifth modification H05, the total amount of current may be increased when the image density is low, or the total amount of current may be controlled in accordance with the image forming rate regardless of the image density. Furthermore, the exemplary embodiment is not limited to the process based on the image density of the Y color or the M color. For example, the exemplary embodiment may be modified such that control is performed only when the image densities of both the Y color and the M color are high, or such that the total amount of current for the K color is controlled based on the image densities of the Y, M, and C colors.

In the above exemplary embodiment, the total amount of current is controlled by varying the image forming rate between the monochrome mode and the full-color mode. However, the exemplary embodiment is not limited to this configuration. In a sixth modification H06, while image formation is performed at the same image forming rate between the monochrome mode and the full-color mode, the control for increasing the total amount of current may be performed in the full-color mode and the control for increasing the total amount of current may be not performed in the monochrome mode. Although it is desirable to change the total amount of current between the monochrome mode and the full-color mode, the exemplary embodiment is not limited to this configuration. The control for increasing the total amount of current may also be performed in the monochrome mode.

The above exemplary embodiment relates to a case where the image forming rate has two levels, that is, a high rate and a low rate. Alternatively, in a seventh modification H07, the exemplary embodiment may be applied to a case where the image forming rate has three or more levels. In this case, the first-transfer current value also increases in correspondence with the three levels. For example, in the case where the three levels include a high rate, an intermediate rate, and a low rate, the total amount of current may be increased in the following order: high rate<intermediate rate<low rate, or the total amount of current may be set as follows: high rate=intermediate rate<low rate or high rate<intermediate rate=low rate.

Although the above exemplary embodiment relates to a case where the first-transfer currents for the Y and M colors are controlled using the same value and the first-transfer currents for the C and K colors are controlled using the same value, the exemplary embodiment is not limited to this configuration. In an eighth modification H08, the first-transfer current values may vary among the Y, M, C, and K colors. For example, the first first-transfer current I1 may be set to different values, such as a first-transfer current I1*y* for the Y color, a first-transfer current I1*m* for the M color, a first-transfer current I1*c* for the C color, and a first-transfer current I1*k* for the K color.

Although it is desirable that a charge remover be not included and that a direct-current power source alone be used for the charging rollers CRy to CRk in the above exemplary embodiment, the exemplary embodiment is not limited to this configuration. In a ninth modification H09, a charge remover may be provided, and the charge remover used may be configured by superposing an alternating-current power source on a direct-current power source.

In a tenth modification H010 of the above exemplary embodiment, correction control for coping with deterioration of a charging unit indicated in the related art may be used in combination with the control of the first-transfer current.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a plurality of transfer members that are arranged in a moving direction of a medium and transfer a visible image on an image bearing member onto the medium, wherein the image rate corresponds to a rate at which the visible image passes through the transfer region, wherein when the image forming rate is low, the total amount of transfer current to be supplied to at least one of the transfer members is larger than the total amount of transfer current to be supplied to another one of the transfer members adjacent thereto at an upstream side, and the total amount of transfer current to be supplied to a remaining one or more of the transfer members is larger than or equal to the total amount of transfer current to be supplied to the transfer adjacent at the upstream side, as compared with when the image forming rate is high.

2. The transfer device according to claim 1, wherein the plurality of transfer members include a yellow-image transfer member, a magenta-image transfer member, a cyan-image transfer member, and a black-image transfer member that are arranged sequentially from the upstream side in the moving direction of the medium, and wherein when the image forming rate is low, the total amount of transfer current to be supplied to the cyan-image and the black-image transfer members is larger than the total amount of transfer current to be supplied to the yellow-image and magenta-image transfer members, as compared with when the image forming rate is high.

3. The transfer device according to claim 1, wherein when a density of an image is high based on the density of the image to be transferred by an upstream one of the transfer members and when the image forming rate is low, the total amount of transfer current to be supplied to a downstream one of the transfer members is larger than the total amount of transfer current to be supplied to the upstream transfer member, as compared with when the image forming rate is high.

4. The transfer device according to claim 1, wherein when a density of an image is low based on the density of the image to be transferred by an upstream one of the transfer members, the total amount of transfer current to be supplied to a downstream one of the transfer members corresponds to the total amount of transfer current to be supplied to the upstream transfer member, even when the image forming rate is low.

5. The transfer device according to claim 1, wherein the plurality of transfer members include a yellow-image transfer member, a magenta-image transfer member, a cyan-image transfer member, and a black-image transfer member that are arranged sequentially from the upstream side in the moving direction of the medium, and wherein when the image forming rate is low, the total amount of transfer current to be supplied to the black-image transfer member is larger than the total amount of transfer current to be supplied to the yellow-image, magenta-image, and cyan-image transfer members, as compared with when the image forming rate is high.

6. The transfer device according to claim 1, wherein if transferring is to be performed by using all of the plurality of transfer members and when the image forming rate is low, the total amount of transfer current to be supplied to the transfer members is increased, as compared with when the image forming rate is high.

7. The transfer device according to claim 1, wherein if transferring of an image is to be performed by using only one of the plurality of transfer members, the total amount of transfer current to be supplied to the transfer member for the image is not increased even when the image forming rate is low.

8. An image forming apparatus comprising:

an image bearing member;

a charging unit that electrostatically charges the image bearing member;

a latent-image forming device that forms a latent image onto the electrostatically-charged image bearing member;

a developing device that develops the latent image into a visible image; and the transfer device according to claim 1 that transfers the visible image on the image bearing member onto a medium.

9. The image forming apparatus according to claim 8, wherein a charge remover that removes electric charge from a surface of the image bearing member after a transfer process is not included.

10. The image forming apparatus according to claim 8, wherein the charging unit is supplied with electric power by using a direct-current power source.

* * * * *